US006640674B1

(12) United States Patent
Rinner et al.

(10) Patent No.: US 6,640,674 B1
(45) Date of Patent: Nov. 4, 2003

(54) SCREWDRIVER HAVING A VARIABLE TORQUE-LIMITING IN-LINE DRIVE

(75) Inventors: James A. Rinner, Racine, WI (US); Hua Gao, Fox Point, WI (US)

(73) Assignee: Pilling Weck Incorporated

( * ) Notice: Subject to any disclaimer, the term of this patent is extended or adjusted under 35 U.S.C. 154(b) by 0 days.

(21) Appl. No.: 10/151,549

(22) Filed: May 21, 2002

(51) Int. Cl.[7] ..... B25B 23/157

(52) U.S. Cl. ..... 81/475; 81/473; 81/474; 81/476; 81/477

(58) Field of Search ..... 81/475, 473, 474, 81/476, 477, 467, 429, 436

(56) References Cited

U.S. PATENT DOCUMENTS

| | | | | |
|---|---|---|---|---|
| 2,732,746 A | | 1/1956 | Livermont | |
| 2,733,622 A | | 2/1956 | Evans | |
| 2,968,979 A | | 1/1961 | Aijala | |
| 3,068,667 A | | 12/1962 | Sussman | |
| 3,205,985 A | | 9/1965 | Pearl | |
| 3,292,678 A | | 12/1966 | Noga | |
| 3,695,059 A | | 10/1972 | Laubach | |
| 3,942,337 A | | 3/1976 | Leonard | |
| 4,062,203 A | | 12/1977 | Leonard | |
| 4,063,474 A | | 12/1977 | Klopping | |
| 4,272,973 A | | 6/1981 | Fu-Tsai | |
| 4,517,865 A | | 5/1985 | Huang | |
| 4,653,359 A | | 3/1987 | Liao | |
| 4,901,610 A | * | 2/1990 | Larson et al. | 81/473 |
| 5,746,298 A | * | 5/1998 | Krivec et al. | 192/48.3 |
| 6,076,439 A | * | 6/2000 | Dzieman | 81/473 |
| 6,095,020 A | | 8/2000 | Rinner | |
| 6,132,435 A | | 10/2000 | Young | |
| 6,155,147 A | | 12/2000 | Dzieman | |
| 6,273,200 B1 | * | 8/2001 | Smith et al. | 173/216 |

* cited by examiner

*Primary Examiner*—Joseph J. Hail, III
*Assistant Examiner*—Alvin J Grant
(74) *Attorney, Agent, or Firm*—Arthur J. Hansmann

(57) ABSTRACT

A screwdriver of the type having a variable torque-limiting in-line drive with a handle having a cavity and a drive bit disposed in the cavity. Over-ride drive members are disposed in the cavity and a spring exerts a force on the drive members for transmitting only a maximum force to a bit in the screwdriver. Two adjustable controls are at a back end of the tool and they are used to apply a varying force to the spring and thus limit the amount of maximum torque to be transmitted.

17 Claims, 2 Drawing Sheets

Fig. 1
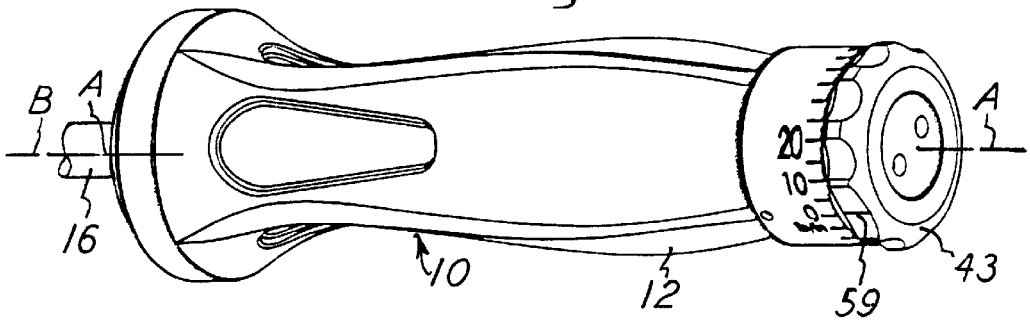
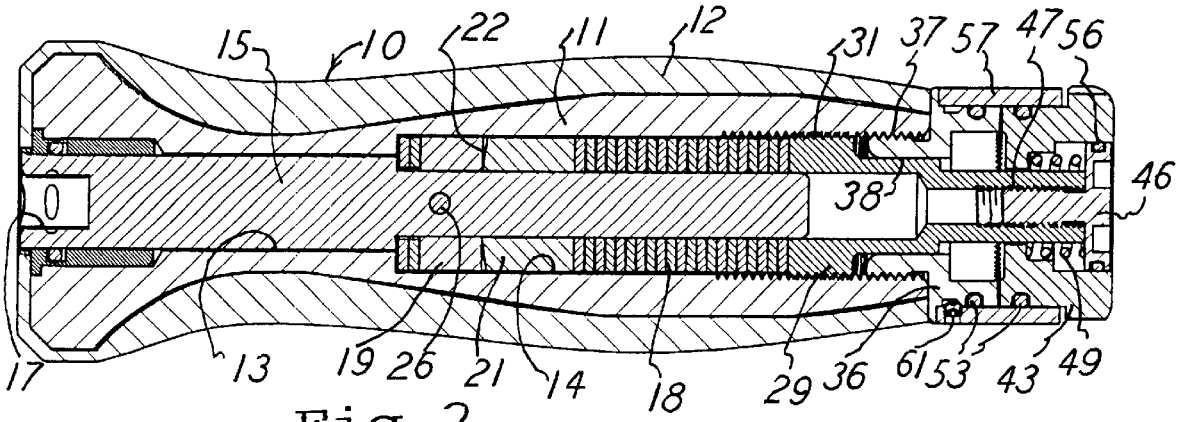
Fig. 2
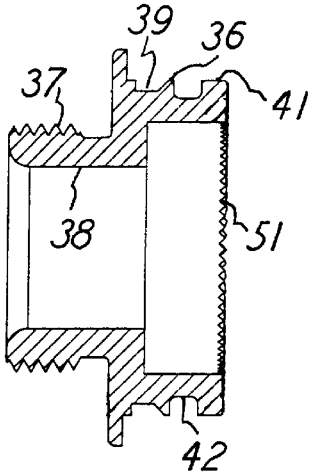
Fig. 4
Fig. 3
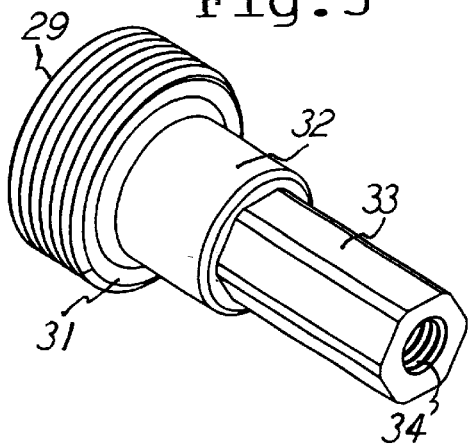

SCREWDRIVER HAVING A VARIABLE TORQUE-LIMITING IN-LINE DRIVE

This invention relates to a screwdriver of the type having a variable torque-limiting in-line drive.

BACKGROUND OF THE INVENTION

Screwdrivers with gear mechanisms, or the like, are commonly in use in various fields, including the medical instrument field where this invention is useful. Those screwdrivers have an elongated handle with gear-type teeth or the like within the handle and with a spring pressing on the teeth to hold the teeth in mutual engagement while the handle is being rotated to apply a torque to a work piece such as a screw. Also, in that arrangement, the gear teeth may be held together for a transmission therebetween of a maximum torque applied to the work piece. Even further, the screwdriver might have an adjustment which permits adjusting the force of the spring on the gear teeth to thereby adjust the maximum torque transmitted through the handle and to the work piece.

The present invention provides an adjustable control for applying selective forces on the gears or the like and doing so with a spring which forces on the gears in accord with the setting of the adjustable control.

Still further, the aforementioned adjustable control can have indicia thereon, such as graduation markings, so that the adjusted position of the control can be readily detected by the user and thus the control can be set in a desired position for effecting the desired spring force on the gears or those items which are transmitting the torque.

Also the control itself has an adjustable rotational stop for an initial setting to permit the movement of the control to be to a maximum amount and thereby have the screwdriver able to transmit up to a maximum torque from that selected initial setting. Thus, the range of the setting can be selected.

In that arrangement, it is desirable to have the adjustable control rotatable on the handle so that it can be set in the desired position but also have the control limited in its adjustable positioning so that it will operate exclusively within only a range of adjustment and not exceed its positioning to where it could actually become disconnected or otherwise fail in its operation. The entire arrangement is such that the operator can set the adjustable control to one of various selectable torque-limiting positions, and the operator can be assured that each time the control is set in that position that the desired maximum torque will be transmitted by the screwdriver, and the transmitted torque will be limited to that one maximum amount in accord with that one setting of the adjustable control.

In this invention, the screwdriver is elongated and has a handle with a rear end, and that is where the controls are located for setting the limit to the transmitted torque. Thus, the surgeon, or other user, can securely hold the handle with one hand and have access to and adjustment of the torque controls, all for accuracy of the desired settings.

Still further, the screwdriver is constructed to have its moving parts in relationships and positions of inter-related support and close tolerance, so the settings and the use are precise.

BRIEF DESCRIPTION OF THE DRAWINGS

FIG. 1 is a perspective view of a preferred embodiment of a screwdriver of this invention with a fragment of a tool bit shown thereon.

FIG. 2 is an enlarged longitudinal sectional view of the screwdriver of FIG. 1.

FIG. 3 is an enlarged perspective view of a part shown in FIG. 2.

FIG. 4 is an enlarged sectional view of a part as seen in FIG. 1.

DETAILED DESCRIPTION OF THE PREFERRED EMBODIMENT

Figure 5:
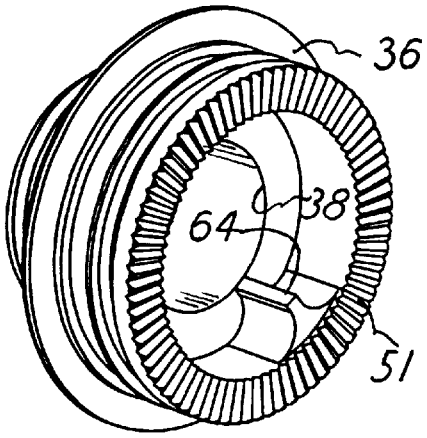
FIGS. 5, 6, 7, and 8 are enlarged perspective views of parts shown in FIG. 2.

FIGS. 1 and 2, show the screwdriver of this invention includes a handle, generally designated 10, having a core or body portion 11 and a cover portion 12 which may be a silicone or like resilient cover encapsulating the core 11. The handle 10 is shown elongated, and it has a longitudinal axis A and a longitudinal cavity which extends co-axially with the axis A in two contiguous but different diameters at cavity lengths 13 and 14. A shaft 15 is disposed in the cavity and extends along the axis A and is snugly and rotatably disposed in the cavity portion 13. An elongated bit 16 can be inserted into an opening 17 in the shaft 15, and it has its own elongated axis B coaxial with the handle axis A to extend therealong as fragmentarily shown in FIG. 1. Thus the bit 16 is at the front end of the screwdriver.

Figure 9:
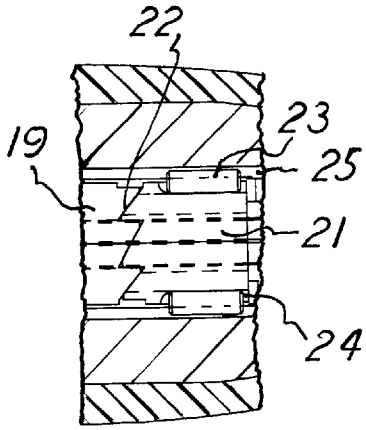
FIG. 9 is a sectional and fragmentary view of the gear portion, similar to FIG. 1.

A plurality of annular Belleville washers 18 are disposed within the cavity 14 and surround a length of the shaft 15. As such, the washers 18 serve their usual purpose of being a spring which exerts a force along the axis A, in the customary manner. Also, coaxial with the bit 16 are a first gear member 19 and a second gear member 21, both of which are annular and are disposed within the cavity 14. The members 19 and 21 are the drive transmission members, and they have the well-known inter-engaged teeth or ramps 22 disposed on each for rotation drive connection between the two members 19 and 21. FIG. 9 shows that the teeth 22 are slanted to transmit only limited clockwise rotational drive between the gears 19 and 21, but the teeth are also cut to transmit unlimited counterclockwise rotational drive between the gears 19 and 21.

In the arrangement shown, the member 21 can be in rotation drive and axial movement relationship with the handle 10, such as by well-known means of rollers 23 drivingly disposed between the gear 21 and the handle 10, as seen in FIG. 9. Rollers 23 are trapped in grooves 24 in the member 21 and in slots 25 in the handle core 11. That is, the arrangement is such that upon rotation of the handle 10 about its longitudinal axis A that rotation is transmitted to the rollers 23 and likewise to the member 21, until the limit of transmitted torque is applied to the screwdriver. The rotation can be in either the clockwise or counter-clockwise direction about the longitudinal axis 13 and as viewed from the right end of FIG. 2, and, for purposes of further describing this invention, it is to be considered that the limited torque rotation is in the clockwise direction as viewed from the right-hand end of FIGS. 1 and 2. Also, the member 21 can move axially, and member 19 can too.

Rotation of the handle 10 and the consequent similar rotation of the member 21 is transmitted to the member 19 when there is engagement at the ramps or teeth 22 which exist on both the members 19 and 21. Thus the member 19 will then also rotate clockwise to rotate the bit 16. The bit 16 is in a rotational drive relationship with the member 19 in any suitable arrangement such as through a pin 26 engaging the gear 19 and the shaft 15. When member 21 rotates, say clockwise, the bit 16 is not directly driven by the member 21, and it is driven only through the gear 21 imposed onto the gear 19. That is, the shaft 15 is not driven directly by the gear 21.

Other arrangements could be employed for the rotational drive from the handle to the bit 16. One example of another arrangement is such as that shown in my U.S. Pat. No. 6,095,020.

With just that portion of the aforementioned description, it will be understood by one skilled in the art that the rotation of the handle 10 will cause the same rotation of the member 21, and, when that rotation is transmitted through the ramp surfaces 22 which exist mutually on the members 19 and 21, then the member 19 will be rotationally driven to, in turn, rotate the bit 16. However, when the bit 16 meets the maximum torque setting of this tool, then the inclined or angulated surfaces 22 will simply slide relative to each other, and the bit 16 will not be rotated. Thus, the maximum transmitted torque has been established, as desired.

FIG. 2 further shows an adjusting control screw 29 threaded into the handle core 11 by means of screw threads on the core 11 and mating screw threads on the member 29 and with those threads being at the mutual location 31 along the wall of the cavity 14. That is, the piece 29 is threaded into the handle cavity 14 and abuts the spring washers 18 which in turn abut the gear 21 to cause the ramps or teeth 22 to be in nonsliding, or rotational drive, contact with each other up to a certain torque limit.

It can now be seen and understood that the position of the cylindrical piece 29 along the axis A, such as established by the screw threads at 31, determines the force exerted on the spring 18 and thus determines the force for the limited torque transmitted between the angulated surfaces 22 of the members 19 and 21. Particularly FIG. 3, shows that the member 29 has a cylindrical length 32 and a flat-sided length 33, shown in the form of a hexagonal shape. Also, the end of the member 29 has internal threads at 34. It will be understood that the member 29 is an adjustable control and it is disposed at the rear end of the screwdriver, that is, at the right end as seen in FIGS. 1 and 2.

A cylindrical insert member 36 is seen in FIGS. 2, 4, and 5, and it serves as a guide to other parts and it has threads 37 for fixedly threading into the handle 11, and that is in the cavity 14. The guide 36 has a cylindrical bore 38 which snugly receives and supports the control 29 at a cylindrical length 32 of the control 29 which can slide in the bore 38 for the adjustable positioning of the control 29, as mentioned. To secure insert 36 in a fixed position on the handle 11, thread locking material can be used. Member 36 presents a groove 39 and a circular surface 41 and an O-ring groove 42, with all three extending therearound.

Figure 6:
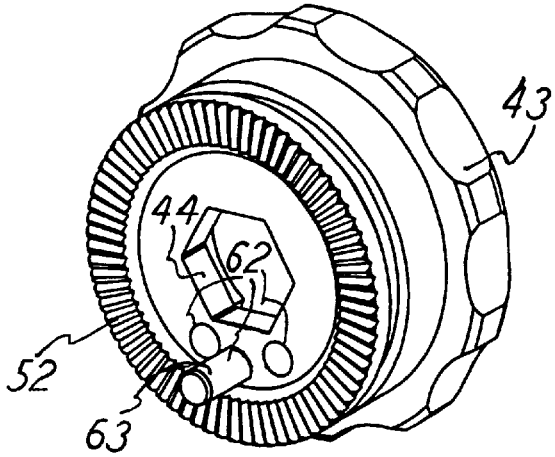

A cylindrical member 43, serving as another adjustable control, has a flat-sided central opening 44 extending therein for a short axial length, as seen in FIGS. 2 and 6. The two hexagonal shapes 33 and 44 mate in a slidable but snug relationship, and control 43 is piloted on the control 29. The relationship is such that rotation of the control 43 induces the same rotation in the other control 29, and that causes control 29 to thread axially along the cavity 14 and thereby adjust the axial force on the spring 18 and thus determine the torque limit for the screwdriver.

Figure 7:
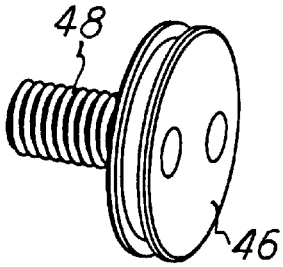

Control 43 is restrained in its axial freedom on the control 29 by an end stop 46 threaded at 47 into the opening 34 in the control 29 to a fixed axial position relative thereto. FIG. 7 shows the stop 46 with its threads 48. A cylindrical compression spring 49 is disposed between the control 43 and the stop 46 to urge the control 43 leftwards to the position shown in FIG. 2. Guide 36 and control 43 have teeth 51 and 52, respectively, and those teeth are mutually engaged in the leftward position of the control 43. Thus, the control 43 cannot then rotate, so neither can the control 29. In that manner, the adjusted position of the control 29 is established for producing the limit to the torque transmittable with the screwdriver. The control 43 can be pulled rightwardly against the spring 49 and away from the insert 36 and thereby release the control 43 for rotation to induce the same rotation in the control 29. Upon release of the pull on control 43, the spring 49 will cause the control 43 to engage insert 36 and thus lock in the selected rotated position.

It will also be seen that O-rings 53 surround the insert 36 and the control 43, and an O-ring 56 surrounds the stop 46, all for cleanliness.

Figure 8:
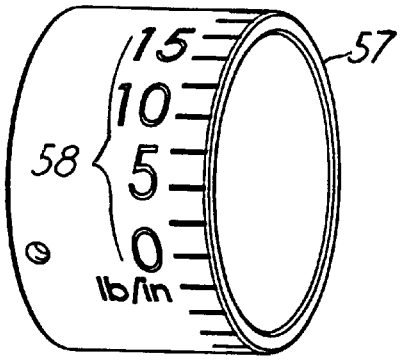

A cylindrical sleeve 57 is snugly mounted onto insert 36 and the control 43 and their O-rings, and it has a scale 58 with numerals, in either form shown in FIG. 1 or 8, and the scale 58 will show the amount of torque. FIG. 1 shows that the control 43 has a scale mark 59 which aligns with the scale 58. The sleeve 57 is rotatably adjustably attached by a set screw 61 which extends through the sleeve 57 and enters the circular groove 39 on the guide 36 and abuts the guide 36. With that arrangement, the zero identifier on the sleeve 57 can be adjustably aligned with the mark 59 on the control 43.

Control 43 has three holes 62 facing the guide 36, and a pin 63 is supportably insertable into any selected one of the three holes 62, such as shown with the center hole 62 in FIG. 6. Guide 36 has affixed thereto a stop 64 which aliens with the pin 63 to preclude rotation of the control 43 beyond a position of having the pin 63 pass the stop 64. Hole 62 is selected for receiving pin 63 so there can be maximum rotation of the control 43, and the starting point for that rotation will be at the lowest torque required. The hole selection is made in conjunction with the slipping of the control 43 onto the control 29, and the flat-sided mating connection of 33 and 44 determines the relative rotated position therebetween. Of course that also depends on the final rotated position of the guide 36.

In all, it will be understood that the controls 29 and 43 are all together and at the rear end of the screwdriver. The surgeon can conveniently and securely hold the elongated handle 10 with one hand and then adjust control 43 with the other hand.

While basically only one embodiment is disclosed herein, it will be apparent to one skilled in the art that changes can be made in that embodiment in the form of equivalent parts. The scope of the claims should determine the extent of the patent protection.

What is claimed is:

1. In a screwdriver of the type having a variable torque-limiting in-line drive having a handle with a longitudinal axis and a forward end and a rearward end along said axis and a cavity extending along said axis between said ends for receiving an elongated drive bit disposable in said cavity at said forward end and extending from said handle for engaging an object to be rotationally driven by said screwdriver, two gears disposed in said cavity and having a common central axis co-axial with said longitudinal axis and said gears having teeth thereon in mesh between said gears on a plane transverse to said central axis and said gears being arranged for rotation of only one of said gears about said central axis in one direction of rotation and relative to the other of said gears when subjected to a limited torque, said bit being rotatably connectable to said other of said gears, and a torque spring in said cavity and being operative on said one gear for yieldingly urging said gears into mesh with each other to thereby limit the rotation torque transmitted between said two gears in said one direction, the improvement comprising:

a first adjustable control disposed in said cavity at said rearward end of said handle and being rotationally threaded to said handle and threadedly operative on said torque spring in the direction along said central axis for applying axial force on said gears to establish the limit of rotation torque transmitted between said gears to said bit, a second adjustable control at said rearward end of said handle and rotationally mounted on said handle and being rotationally connectable with said first adjustable control and extending externally of said handle whereby said second adjustable control is accessible exteriorly of said handle and said adjustable controls are operationally associated with each other for threaded operation of said first adjustable control on said handle to establish the torque transmitting force between said gears, said second adjustable control being movable for selective releasable connection with said handle for selectively securing said controls against rotation on said handle, and a control spring operative on said second adjustable control to yieldingly urge said second adjustable control into releasable rotational relationship with said handle to establish the torque limit.

2. The screwdriver as claimed in claim 1, including:

a sleeve mounted on said handle rearward end and having a numerical scale thereon, and said second adjustable control having a mark thereon adjacent said sleeve to indicate the rotated position of said second adjustable control relative to said handle and thus indicate the amount of torque transmitted by said screwdriver.

3. The screwdriver as claimed in claim 2, wherein:

said sleeve is rotatably adjustably mounted on said handle for aligning said scale with said mark.

4. The screwdriver as claimed in claim 1, wherein:

said first adjustable control is in direct contact with said torque springs to be threadedly operative thereon.

5. The screwdriver as claimed in claim 1, including:

said cavity extends along said axis and is in two diametrical sizes different from each other, a drive shaft in said cavity to be rotationally supported on said handle for transmitting rotation drive from said handle and said other gear to said bit which can be connected with said shaft, and said gears and said torque spring being disposed in the larger of said two diametrical sizes.

6. The screwdriver as claimed in claim 5, wherein:

said first adjustable control is threaded to said handle at said larger of said two diametrical sizes and has a bore and said shaft is rotatably supported in said bore.

7. The screwdriver as claimed in claim 1, including:

a member threaded into said handle at said cavity and presenting a circular support for said first adjustable control.

8. The screwdriver as claimed in claim 7, wherein:

said second adjustable control and said member have mutually engagable portions for releasably holding both said adjustable controls in selected rotationally secured relationship with said handle to establish the torque limit.

9. The screwdriver as claimed in claim 1, including:

a shaft rotatably disposed in said cavity for supporting said bit, and said first adjustable control has a bore on said axis and said shaft is rotatably supported in said bore.

10. The screwdriver as claimed in claim 1, including:

said second adjustable control has a circle centered on said axis and there are a plurality of holes spaced apart along said circle, a pin insertable into any selected one of said holes and projecting toward said handle and parallel to said axis, and a stop on said handle to stop said pin upon rotation of said second adjustable control and thereby limit rotation of said second adjustable control relative to said handle.

11. In a screwdriver of the type having a variable torque-limiting in-line drive having a handle with a longitudinal axis and a forward end and a rearward end along said axis and a cavity extending along said axis between said ends for receiving an elongated drive bit disposable in said cavity at said forward end and extending from said handle for engaging an object to be rotationally driven by said handle, two gears disposed in said cavity and having a common central axis co-axial with said longitudinal axis and said gears having teeth thereon in mesh between said gears on a plane transverse to said central axis and said gears being arranged for rotation of only one of said gears about said central axis in one direction of rotation and relative to the other of said gears when subjected to a limited torque, said bit being rotatably connectable to said other of said gears, and a torque spring in said cavity and being operative on said gears for yieldingly urging said gears into mesh with each other to thereby limit the rotation torque transmitted between said two gears in said one direction, the improvement comprising:

a first adjustable control disposed in said cavity at said rearward end of said handle and being movably threadedly connected with said handle and threadedly operative on said torque spring in the direction along said central axis for applying axial force on said gears to establish the limit of rotation torque transmitted between said gears to said bit, a second adjustable control at said rearward end of said handle and rotatably mounted on said handle and being rotatably connectable with said first adjustable control and extending externally of said handle and said adjustable controls are operationally associated with each other for threaded operation of said first adjustable control on said handle to establish the limit of torque transmitted between said gears, a member fixed on said handle and being engagable with said second adjustable control for holding said controls against rotation, said second adjustable control being movable on said handle for selective release from said member for rotation of said controls on said handle, and a control spring operative on said second adjustable control to yieldingly urge said second adjustable control into holding said controls against rotation.

12. The screwdriver as claimed in claim 11, including:

said second adjustable control has a circle centered on said axis and there are a plurality of holes spaced apart along said circle, a pin insertable into any selected one of said holes and projecting toward said handle and parallel to said axis, and a stop on said handle to stop said pin upon rotation of said second adjustable control and thereby limit rotation of said second adjustable control relative to said handle.

13. The screwdriver as claimed in claim 11, including:

a guide on said handle and being in supportive relationship of said first adjustable control and in rotation restriction of said second adjustable control.

14. The screwdriver as claimed in claim 11, wherein:

said second adjustable control is mounted on said first adjustable control for transmitting rotation from one to the other of said controls.

15. In a screwdriver of the type having a variable torque-limiting in-line drive having a handle with a longitudinal axis and a cavity extending along said axis for receiving an elongated drive bit disposable in said cavity at and extending from said handle for engaging an object to be rotationally driven by said handle, two gears disposed in said cavity and having a common central axis co-axial with said longitudinal axis and said gears having teeth thereon in mesh between said gears on a plane transverse to said central axis and said gears being arranged for rotation of only one of said gears about said central axis in one direction of rotation and relative to the other of said gears when subjected to a limited torque, said bit being rotatably connectable to said other of said gears, and a torque spring in said cavity and being operative on said gears for yieldingly urging said gears into mesh with each other to thereby limit the rotation torque transmitted between said two gears in said one direction, the improvement comprising:

a first adjustable control disposed in said cavity and extending along said cavity and being movably threadedly connected with said handle and threadedly operative on said torque spring in the direction along said central axis for applying axial force on said gears to establish the limit of rotation torque transmitted between said gears to said bit, a second adjustable control rotatably mounted on said handle and being rotatably connectable with said first adjustable control and extending externally of said handle and said adjustable controls are operationally associated with each other for threaded operation of said first adjustable control on said handle to establish the limit of torque transmitted between said gears, a member fixed on said housing and being engagable with said second adjustable control for holding said controls against rotation, said second adjustable control being movable on said handle for selective release from said member for rotation of said controls on said handle, and a control spring operative on said second adjustable control to yieldingly urge said second adjustable control into holding said controls against rotation.

16. The screwdriver as claimed in claim 15, wherein:

said second adjustable control is mounted on said first adjustable control to be in constant rotation connection therewith.

17. The screwdriver as claimed in claim 15, including: a guide on said handle for snugly slidably engaging said first adjustable control for its rotation and threaded movement.

* * * * *